United States Patent [19]

Olson

[11] 4,095,641

[45] Jun. 20, 1978

[54] ATTACHMENT FOR AN OVERHEAD DOOR

[76] Inventor: Bruce Edgar Olson, 2341 - 208th St., Langley, British Columbia, Canada

[21] Appl. No.: 757,837

[22] Filed: Jan. 10, 1977

Related U.S. Application Data

[63] Continuation of Ser. No. 640,918, Dec. 15, 1975.

[51] Int. Cl.[2] ..... E05D 15/24

[52] U.S. Cl. ..... 160/209; 160/201

[58] Field of Search ..... 160/201, 209

[56] References Cited

U.S. PATENT DOCUMENTS

| | | | |
|---|---|---|---|
| 1,508,886 | 9/1924 | Dautrick et al. | 160/209 |
| 2,006,228 | 6/1935 | Collins | 160/209 |
| 2,090,146 | 8/1937 | Pixley | 160/209 |
| 2,276,976 | 3/1942 | Howell et al. | 160/209 |
| 2,289,045 | 7/1942 | Rowe | 160/209 |
| 2,625,221 | 1/1953 | McKee et al. | 160/209 |
| 3,484,812 | 12/1969 | Holland | 160/201 |

*Primary Examiner*—Peter M. Caun

*Attorney, Agent, or Firm*—James D. Givnan, Jr.

[57] ABSTRACT

An attachment for use with an overhead door having limited head room. The door is made of hingedly connected sections and movable between a closed and an open position on a track. The attachment comprises a first member adapted to be attached to the top section of the door. A second member is pivotally connected to the first member. Track engagement means are attached to the second member and abutment means are positioned on the second member to abut a stop positioned on the exterior of the track when the door is in the closed position. Abutment of the abutment means on the stop acts to stop movement of the second member in the track at a point just prior to the door reaching the closed position.

4 Claims, 10 Drawing Figures

FIG. 1.
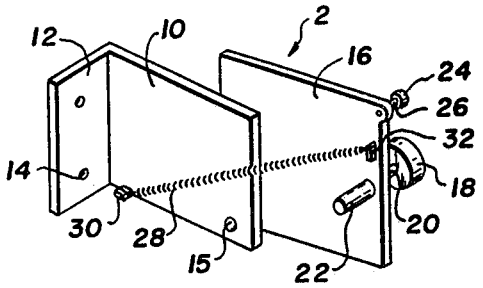
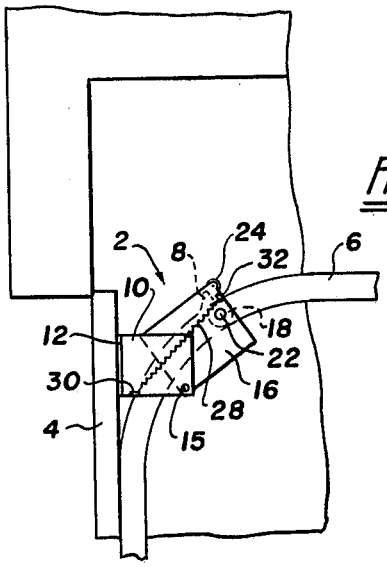
FIG. 2.
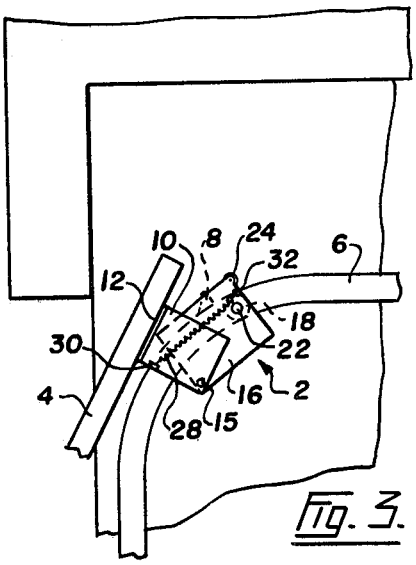
FIG. 3.
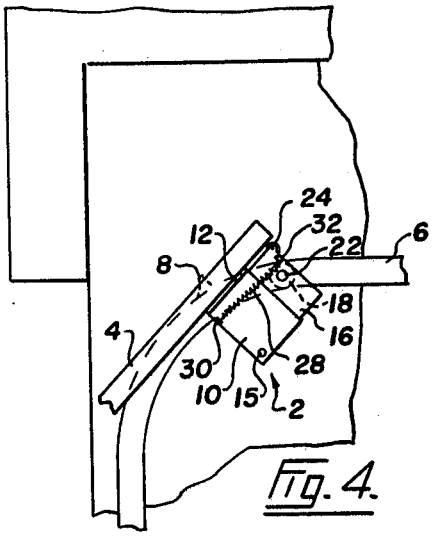
FIG. 4.

ATTACHMENT FOR AN OVERHEAD DOOR

RELATED APPLICATION

The present application is a continuation in part of my application Ser. No. 640,918 filed Dec. 15, 1975.

BACKGROUND OF THE INVENTION

1. Field of the Invention

This invention relates to an attachment for use with an overhead door having limited headroom and made of hingedly connected sections.

2. Description of the Prior Art

Overhead doors for garages and warehouses and the like are well known. Generally speaking, the doors are made up on hinged sections, each section having a bracket extending from it to which is attached a roller member. The roller member engages in a track that is made up of a vertical section, substantially parallel to the door when the door is closed, a horizontal section, substantially parallel to the ground, in which the door rests when it is fully opened and a curved portion joining the vertical and horizontal portions. Typically, these doors have counterweights to facilitate their opening. Generally speaking, a wire rope is attached to the bottom of the door, runs upwardly, over a cable drum and downwardly to attach to a counterweight. In a typical domestic garage door there are two counterweights, one on each side of the door. Generally speaking, the combined weight of the counterweights is slightly less than the weight of the door. When the doors are closed the counterweights are raised. Thus, relatively slight pressure applied by hand to the door overcomes the difference in the weight of the door over the counterweight and the door can be lifted by hand easily. As the door is lifted the roller members attached to each section move upwardly in the vertical portion of the track, around the curved portion of the track and along the horizontal portion of the track.

Torsion springs are also widely used to reduce the opening effort. These are also used with a cable drum.

A problem is encountered with overhead doors having limited headroom. By limited headroom is meant that there is relatively little space between the upper edge of the upper section of the door and the roof of the garage. The cable drum is generally fitted in this space. With limited headroom the well known problem is that the upper section of the door hits against the cable drum if the distance between the upper section and its roller—engaged in the track—is greater than the distance between the lower surface of the drum and the track. This problem comes about because the roller of the upper section must engage in the track where is starts to curve away. Thus, the bracket upon which the roller for the top section is mounted must be fairly long. With adequate headroom it is not necessary to have an excessively long bracket. The track can be designed so that the curve in the track does not start until after the part of the track engaged by the upper section roller when the door is closed.

A number of devices have been designed to overcome the above disadvantage with overhead doors having limited headroom. The most popular method is to use a separate track just for the roller of the upper section. The separate track is generally disposed parallel and above the horizontal portion of the existing track that engages the rollers for the remaining section of the door. But the separate track only curves down gently at its end and finishes in the vicinity of the upper section of the door in such a way that the upper section can be provided with a roller on a fairly short bracket, in particular a bracket shorter than the distance between the cable drum and the track. The effect of the separate track is to ensure that the upper section immediately starts to move towards horizontal position upon opening of the door.

However the incorporation of an additional track and its mounting is clearly an expense.

SUMMARY OF THE INVENTION

The present invention seeks to avoid the disadvantages of the additional track by providing a simple device that can engage in an existing curved track and be attached to the upper section of a door for use where there is only limited headroom.

In particular, the present invention is an attachment for use with an overhead door having limited head room, the door being made of hingedly connected sections and movable between a closed vertical position and an open, horizontal position on single continuous tracks, one track positioned on each side of the door and each track comprising an inner, roller-receiving side of an outer side, the fitting comprising, a first member adapted to be rigidly attached to the top section of the door and extending, when the door is in its useful position, past the inner edge of a track to terminate so that part of the first member is past an edge of the track remote from the door, a pivot point in said part of the first member, a second member pivotally attached to the first member at said pivot points, a roller rotatably mounted in the second member to extend, when the fitting is in its useful position, to engage the inner side of the adjacent track, an abutment on the second member than, when the fitting is in its useful position, is above the roller and extends outwardly over the track, a stop positionable on each track to contact the abutment on a fitting, means to restrict relative pivoting of the first and second members, whereby, on opening, a door having a fitting adjacent each of its upper corners, the first movement of the fitting is preferential pivoting of the first and second members with consequent restriction of the amount of the upward movement of the top section of the door until the means to restrict relative pivoting comes into effect and, on closing, the abutment on the second member contacts the stop on the track prior to the door reaching the closed position, subsequent pivoting of the first and second members acting to maintain the upper edge of the upper section relatively close to the track as the door continues to the closed position.

BRIEF DESCRIPTION OF THE DRAWINGS

An embodiment of the invention is illustrated in the accompanying drawings in which:

FIG. 1 is a perspective view of an attachment according to the present invention;

FIG. 2 illustrates the attachment of FIG. 1 in its useful position;

FIG. 3 illustrates the operation of the device illustrated in FIG. 1;

FIG. 4 illustrates a further step in the use of the device;

DESCRIPTION OF PREFERRED EMBODIMENTS

Figure 5:
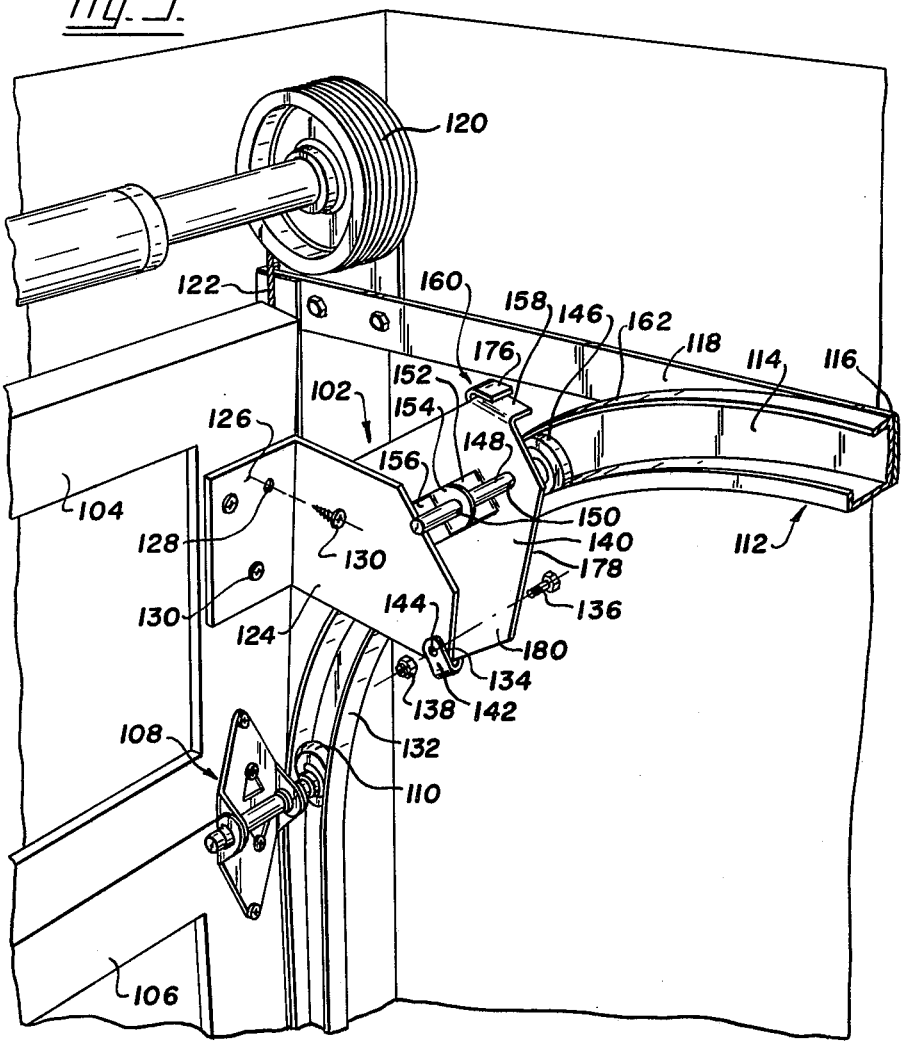
FIG. 5 illustrates a further embodiment of the invention in position on a door.

FIG. 1 illustrates an attachment generally indicated at 2 for use with an overhead door made up of a plurality of hingedly connected sections. The drawings illustrate only partially the top section 4. It should be emphasized that the remainder of the door is conventional. An advantage of the present invention is that no modification of conventional tracks or doors is necessary. It is merely necessary to attach the device according to the present invention to the existing, conventional top section of an existing, conventional door to use it on existing, conventional tracks.

The door is movable between a closed and an opened position on a track 6. As illustrated most clearly in FIG. 4 in the invention the conventional track 6 is modified by incorporating a stop 8 on the exterior of the track.

The attachment comprises a first member 10 formed with a flange 12 provided with holes 14 to enable its attachment to the door section 4 by bolts or screws. The first section 10 is pivotally connected by a pin 15 to a second member 16. Second member 16 is provided with a roller 18 fixedly attached to a shaft 20 that is rotatably mounted in a housing 22. The roller 18 runs in the track 6 as indicated in FIGS. 2 to 4.

The second member 16 is provided with an abutment means in the form of a small roller 24 mounted on a shaft 26. The roller 24 is positioned in such a way that it abuts against the stop 8 on the exterior of the track in a manner and for a purpose to be described later.

In the preferred embodiment illustrated in FIG. 1 the attachment is provided with a spring 28 which urges the first member 10 and the second member 16 from the position shown in FIG. 1—that is the position when the door is closed and the spring 28 fully stretched—to the position shown in FIG. 4 in which the members 10 and 16 have been urged towards one another. Spring 28 is mounted on a first lug 30 on the first member 10 and on a second lug 32 on the second member 16.

In use the attachment 2 according to the present invention operates in the following manner:

With the door closed the attachment 2 is in the position shown in FIG. 2. The abutment roller 24 on the second member 16 is against the stop 8 on the exterior of the track 6. When the door is lifted by hand the initial effect on the attachment 2 is a pivoting of the first member 10 about pin 15 which brings the door section 4 quickly to the horizontal position. When the pivoting is completed, for example as shown in FIG. 4, the door moves along the upper section of the track 6 and the various parts of the attachment do not move relative to one another except for the roller 18 rolling in the track 6. That is after a certain point has been reached the components of the attachment 2 remain in the position shown in FIG. 4 as first plate 10 abuts housing 22 and prevents further overlap of member 10 and 16. If necessary a separate stop (not shown) can be provided to restrict overlap. It should be noted that the spring 28 facilitates in the closing of the device but this component is not essential. A satisfactory attachment 2 can dispense with the spring 28.

Upon closing the door the sequence illustrated in FIGS. 2 to 4 is reversed. Thus, as the upper section 4 with the attachment 2 approaches the closed position the abutment roller 24 abuts the stop 8 on the exterior of the track 6. Further movement of the second member 16 down the track 6 is thus prevented but the top section 4 can continue to move because the first members 10 can pivot about 15 to enable the top section 4 of the door to move to its closed position.

The attachment 2 shown in FIGS. 1 to 4 may be made of, for example, 3/16-inch thick steel plate. It may be desirable to incorporate means to restrict overlap of the members 10 and 16 relative to one another. However, generally speaking tubular member 22 will prevent an excessive overlap. Alternatively, the first member 10 will be prevented from excessive pivoting by contact with the lug 32. Furthermore, excessive pivoting is generally prevented by the fact that the door section 4 is fixed at one end by the presence of the roller 18 in the track 6 and by its hinged connection at its other end to the remainder of the door.

The roller 24 may be replaced by a simple projection welded to the second member 16.

As indicated above, spring 28 is not essential and may be dispensed with.

FIGS. 5 to 10 illustrate a further embodiment of the invention. That embodiment is shown in position in FIG. 5. FIG. 5 illustrates an attachment generally indicated at 102 for use with an overhead door having limited head room. The door is made of a top section 104 and a plurality of other sections, only one of which (106) is shown. Section 106 is hingedly attached to top section 104 in conventional manner generally indicated at 108. It should be noted that hinged connection 108 includes, as is conventional, a roller 110. The door is movable between a closed, vertical position in which it is shown in FIG. 5 on single continuous tracks, one track 112 being illustrated in the drawings. There is one such track 112 positioned on each side of the door. Each track comprises an inner roller receiving side 114 and an outer side 116. Outer side 116 is conventionally attached to stabilizing brackets 118. The opening of the door is assisted by cable drums 120 from which cables 122 extend and are attached to the door. Cables drums 120 and the attached hardware is conventional.

The illustrated attachment 102 comprises a first member 124 that is rigidly attached to the top section 104 by the provision of flange 126 provided with holes 128 to received locating screws 130. In the useful position illustrated in FIG. 5 it can be noted that the first member 124 extends past the inner edge 132 of track 112 to terminate at a position so that part of the first member is past the inner edge 132 of the track 112. The inner edge 132 is the edge of the track remote from the top door section 104 and is on the inner side of, for example, a garage or other buildings fitted with the door. There is a pivot point 134 in that corner of first member 124 remote from the flange 126. The pivot point 134 is, in the illustrated embodiment, although not properly shown in FIG. 5, simply a hole to receive pivot pin 136, shown exploded from the device 102 in FIG. 5. Pivot pin 136 is held in place by the positioning on it of nut 138-also shown exploded in FIG. 5.

There is a second member 140 pivotally attached to the first member 124 at 134 by the pivot means shown as a horizontal pivot pin 136. The pivotal attachment is simply provided by the provision of a flange 142 that extends backwardly from the second member 140 and is folded around to be parallel to said first member 124. A pair of aligned holes, only one of which 144 is shown, are then formed to receive the pivot pin 136 which, of course, also extends through the pivot point or hole 134 in the first member 124.

There is a roller 146 rotatably mounted in the second member 140. Roller 146 is mounted by the provision of a shaft 148 to provide an assembly supported in a pair of aligned holes 150 formed in the second member 140. In the preferred embodiment illustrated in FIG. 5 the innermost of the pair of holes 150 is formed by pressing out a flange 152 from the body of the second member 140. A lug 154 is then formed on the end of the flange 152 and the inner hole 150 drilled in lug 154. The resulting aperture 156 in the second member 140 has not been found to weaken the device in any appreciable way. Roller 146 extends to engage the inner side 114 of the track 112 to which the attachment 102 is adjacent. The forming of the inner edge 114 of the track 112 and its engagement by the roller 146 is conventional in the overhead door art.

Figure 6:
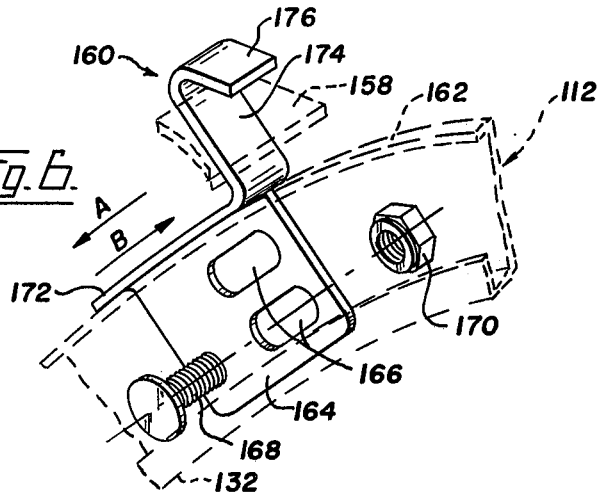
FIG. 6 illustrates the stop shown in FIG. 5.

There is a flange or lip 158 formed on the second member 140 and extending over the track 112. The flange 158 is positioned just over the roller 146. As illustrated in greater detail in FIG. 6 there is a stop 160 postioned on the upper or outer edge 162 of the track 112. This stop is illustrated more clearly in FIG. 6. Stop 160 illustrated in FIG. 6 represents a preferred embodiment of the stop, in that it has a "two way" action. As illustrated in FIG. 6 stop 160 comprises a locating plate 164 with elongated holes 166 to receive locating bolts 168 which are engaged by nuts 170 so that the plate 164 and thus the stop 160 is located on the track 112. Holes 166 are elongated in order to permit variation of the position of the stop 160 and thus tightness of the closing of the overhead door in a manner that will be described later. Plate 164 is attached to a first limb 172 that engages on the outer edge 162 of the track 112. A second limb 174 is angulated and extends upwardly from the outer edge 162 and acts as the stop against which, on closing, flange 158 abuts. An upper or third limb 176 of the stop 160 is angulated with respect to limb 174 and comes into effect to facilitate the opening of the door as will be described later.

The attachment 102 is provided with means to restrict the relative pivoting of the first member 124 and the second member 140. It is seldom necessary to provide a separate item for this function and, in the device illustrated in FIG. 5, the flange 152 pushed out from the second member 140 performs this pivot limiting function as illustrated particularly in FIGS. 9 and 10 as will be described later.

Thus, from the above description, the second member 140 can be considered as having two sides, a first or outer side 178 and a second or inner side 180, flange 158 which makes up the abutment extends to the first side 178. Flange 152 extends to the second side 180 and the lug 154 is formed on its end, again on the inner side 180 of the second member 140. Holes 150 make up a pair of axially aligned holes in the lug 154 and the second member 140. This pair of axially aligned holes 150 receives roller shaft 148. Flange 142 makes up a third flange formed at a corner of the second member 140 remote from the first flange 158 and holes 144 form a second pair of axially aligned holes in said second member 140, and at the third flange 142, to align with the pivot point 134 in the first member 140 to receive pivot pin 136 that extends through the pair of aligned holes 144 and the pivot point 134.

The device illustrated in FIGS. 5 to 10 is desirably pressed from sheet metal and is simple and economical to produce. It is installed as follows:

Tracks 112 are installed in conventional manner after first being cut to the proper length. It must, of course, be ensured that the cable drums 120 clear the ceiling but any radius track will work with the fitting of the present invention. The door is installed in normal fashion except for the attachment of the fitting 102 according to the present invention. The top section 104 of the door is held against the header or upper edge 182 of the door opening-see particularly FIGS. 7 to 10. The fitting 102 is then positioned at the upper corner of the upper section 104 with the roller in the track. The fixture 102 is then moved down-approximately 3½ inches in a typical embodiment — to the position shown in FIG. 5 and screws 130 are then screwed into place. Stop 160 is then located by placing it on the track in the position illustrated in FIG. 5, that is with the limbs 174 and 176 in contact with, or at least very close to, the stop 158. Holes are then drilled in the outer edge 116 of the track 112. These holds are drilled in the middle of the slots 166 of the stop 160 to provide for maximum adjustment either way. It is important that the free end of the third limb 176 at the stop 40 clears the stop 158 by a minimum of a quarter of an inch as the door is closing. Moving the stop 160 in the direction of arrow A shown in FIG. 6 moves the door section 104 away from the header 182 in the closed position. Movement of the stop 160 in the direction of arrow B tightens the door section 104 against the head 182 when the door is closed. A further point that should be observed on installation is that the pivot point 134 shown in FIG. 7 must be within the dashed line C drawn from the outer edge of the flange 158 and the pivot point of the joint 108 between the upper section 104 and section 106. The correct position is illustrated in FIG. 7.

Figure 7:
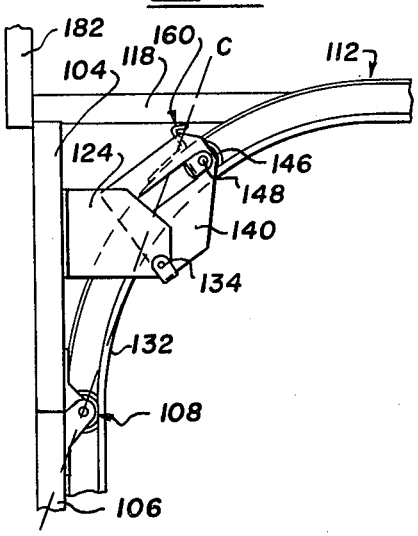
FIGS. 7 to 10 illustrates the operation, on opening the door, of the fitting of FIG. 5.

The operation of the device illustrated in FIGS. 5 and 6 is illustrated in FIGS. 7 to 10. The closed, vertical position of the door is shown in FIG. 7 in which the upper edge of the top section 104 is against the header 182. As the door is opened the first movement of the attachment 102 is a preferential pivoting of the first member 124 about the pivot pin 136. The second member 140 is prevented from moving upwardly in the track because the flange 158 abuts the underside of the third limb 176 of the stop 160. That is in the device of FIG. 5 there is a positive restriction of the movement upwardly of the second member 140. The effect of this preferential pivoting is that the upper section 104 of the door follows a path that is close to the track 112 and, in a useful embodiment, the highest point in the arc of the upper or leading edge of the upper section 104 does not exceed 3½ inches from the outer edge 162 of the track 112. Typically the movement is restricted so that as the leading edge 104 moves upwardly one inch its moves horizontally 4 inches. A typical path is shown by dashed line D in FIG. 10.

Figure 9:
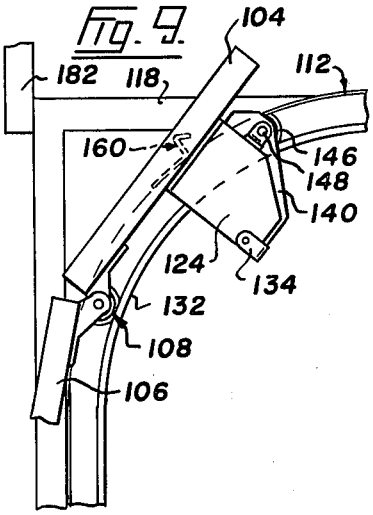

The preferential pivoting of the members 124 and 140 is stopped when the first member 124 contacts the flange 152 that makes up means to restrict the relative pivoting members 124 and 140 as well as a mounting for the roller shaft 148. This position is illustrated in FIG. 9. The second member then moves along the track 112 and the flange 158 moves out of engagement with the stop 160. The fitting remains in the position illustrated in FIGS. 9 and 10 for the remainder of the travel along the upper or horizontal section of the track 112.

Figure 8:
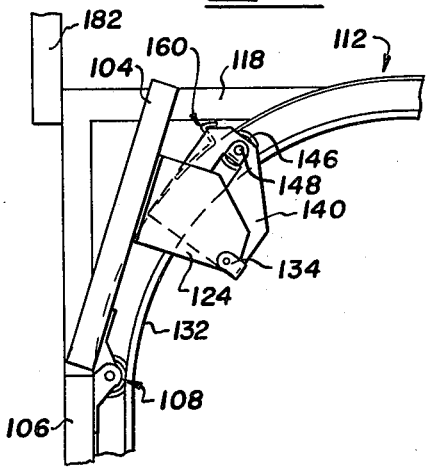
Figure 10:
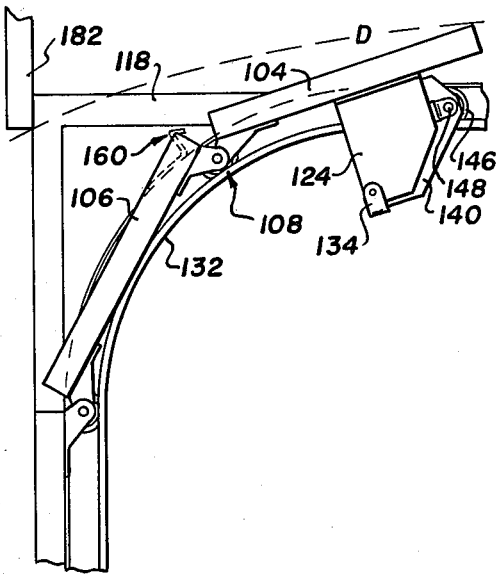

On closing the door it is first brought to the position illustrated in FIG. 10. That is members 124 and 140 are still fully overlapped and continue in the same relative positions through FIG. 9 until, as illustrated in FIG. 8, the flange 158 contacts the stop 160. As the door continues to the closed position, the members 124 and 140 are forced to pivot about 134 with the result that the upper section 104 traces the same low arc path that is pursued on opening.

Irregularities in the track can be overcome because shaft 148 is slidably mounted in holes 150 in the second member 140. This allows roller 146 to move axially relative to the track as the shaft 148 moves axially relative to its mounting in holes 150.

Thus the present invention provides a simple, cheap and effective method of overcoming the disadvantages inherent in the use of an overhead door with low headroom with no modification of existing doors and tracks.

I claim:

1. In combination with an overhead door of the type having limited head room, the door comprised of hingedly connected sections and movable between a closed vertical position and an open, horizontal position within the head room on single continuous tracks, one track each located adjacent a door side and each track including an inner roller supporting edge and an outer edge, the improvement comprising an attachment including, a first member adapted for rigid attachment to a top corner section of the door and extending inwardly past the inner edge of a track so as to have a part thereof disposed at all times inwardly past said track inner edge, a second member in parallel relationship with said first member, pivot means connecting said second member to said first member part disposed inwardly of the track inner edge, means on the members limiting pivotal movement of the members, a shaft and roller assembly carried by said second member with said roller entrained at all times on a single track, an abutment flange on said second member at all times in outward proximity of the track outer edge, a stop disposed on the outer edge of the track coacting with said abutment flange during door travel, such coaction imparting rotational movement to said second member about the axis of said shaft and roller assembly to thereby advance said pivot means and said first member in a direction to expedite closure of the top door section, said stop including angulated limbs, one of said limbs disposed for contact by said abutment flange during door closing travel, another of said limbs of said stop disposed for contact by said abutment flange during initial door opening travel to retard upward travel of the second member and compel occurrence of joint rotational movement of the first and second member about said pivot means, and said top section of the door during initial upward door opening movement moving jointly about the axis of said pivot means which axis simultaneously moves away from the track inner edge about the axis of said shaft and roller assembly to thereby retract the top door section toward the rail to provide clearance from overhead obstructions.

2. The attachment claimed in claim 1 wherein said second member has a first side and a second side, said abutment flange projecting outwardly from said second member toward the adjacent track, a second flange on said second member projecting outwardly therefrom opposite in direction from the abutment flange and constituting the pivot limiting means on the members, said second flange having an apertured lug formed at the flange end to receive one end of the shaft and roller assembly, a third flange associated with said second member and projecting therefrom so as to receive one end of said pivot means and inwardly disposed part of the first member.

3. The attachment claimed in claim 2 wherein said first and second members are formed from sheet metal.

4. The attachment claimed in claim 1 wherein said stop includes mounting means adjustably engageable with the track to permit selective contact of said abutment flange with said stop to commence attachment operation at a desired point of door travel.

* * * * *